US010436070B2

(12) United States Patent
McCaffrey

(10) Patent No.: US 10,436,070 B2
(45) Date of Patent: Oct. 8, 2019

(54) BLADE OUTER AIR SEAL HAVING ANGLED RETENTION HOOK

(71) Applicant: UNITED TECHNOLOGIES CORPORATION, Farmington, CT (US)

(72) Inventor: Michael G. McCaffrey, Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 404 days.

(21) Appl. No.: 15/021,052

(22) PCT Filed: Aug. 28, 2014

(86) PCT No.: PCT/US2014/053040

§ 371 (c)(1),
(2) Date: Mar. 10, 2016

(87) PCT Pub. No.: WO2015/038341

PCT Pub. Date: Mar. 19, 2015

(65) Prior Publication Data

US 2016/0222828 A1 Aug. 4, 2016

Related U.S. Application Data

(60) Provisional application No. 61/876,332, filed on Sep. 11, 2013.

(51) Int. Cl.
*F01D 11/08* (2006.01)
*F01D 11/18* (2006.01)
(Continued)

(52) U.S. Cl.
CPC ..... *F01D 25/28* (2013.01); *F01D 11/08* (2013.01); *F01D 11/18* (2013.01); *F01D 25/24* (2013.01);
(Continued)

(58) Field of Classification Search
CPC ..... F01D 11/08; F01D 11/18; F01D 25/24; F01D 25/246; F01D 25/28;
(Continued)

(56) References Cited

U.S. PATENT DOCUMENTS 5,288,206 A * 2/1994 Bromann ..... F01D 11/24 415/209.2
5,423,659 A 6/1995 Thompson
(Continued)

FOREIGN PATENT DOCUMENTS

FR 2955898 8/2011

OTHER PUBLICATIONS

Supplementary Partial European Search Report for European Patent Application No. 14843324 dated Sep. 7, 2017.
(Continued)

*Primary Examiner* — Woody A Lee, Jr.
*Assistant Examiner* — Christopher R Legendre
(74) *Attorney, Agent, or Firm* — Carlson, Gaskey & Olds, P.C.

(57) ABSTRACT

A blade outer air seal (BOAS) according to an exemplary aspect of the present disclosure includes, among other things, a ceramic body having a radially inner face and a radially outer face and a retention feature that extends from the radially outer face. The retention feature includes at least one angled hook that extends at a transverse angle relative to the radially outer face.

17 Claims, 6 Drawing Sheets

(51) Int. Cl.
*F01D 25/24* (2006.01)
*F01D 25/28* (2006.01)

(52) U.S. Cl.
CPC ..... *F01D 25/246* (2013.01); *F05D 2220/32* (2013.01); *F05D 2230/60* (2013.01); *F05D 2240/11* (2013.01); *F05D 2250/11* (2013.01); *F05D 2250/23* (2013.01); *F05D 2260/30* (2013.01)

(58) Field of Classification Search
CPC ..... F05D 2240/11; F05D 2250/11; F05D 2250/23; F05D 2260/30
See application file for complete search history.

(56) References Cited

U.S. PATENT DOCUMENTS 5,486,090 A 1/1996 Thompson et al.
5,487,642 A * 1/1996 Norton ..... F01D 9/023 415/209.2
5,538,393 A 7/1996 Thompson et al.
6,358,002 B1 3/2002 Good et al.
6,393,331 B1 5/2002 Chetta et al.
6,406,256 B1 6/2002 Marx
6,514,041 B1 2/2003 Matheny et al.
7,052,235 B2 * 5/2006 Alford ..... F01D 9/04 415/173.1
2005/0129499 A1 6/2005 Morris et al.
2005/0271505 A1 12/2005 Alford
2008/0159850 A1 7/2008 Tholen et al.
2009/0208322 A1 8/2009 McCaffrey
2013/0108416 A1 5/2013 Piggush et al.
2013/0209240 A1 8/2013 McCaffrey
2016/0215645 A1 * 7/2016 McCaffrey ..... F01D 25/246
2016/0222828 A1 * 8/2016 McCaffrey ..... F01D 11/18
2016/0319841 A1 * 11/2016 McCaffrey ..... F01D 11/24
2016/0333715 A1 * 11/2016 McCaffrey ..... F01D 25/246
2017/0350268 A1 * 12/2017 McCaffrey ..... F01D 11/08

OTHER PUBLICATIONS

International Search Report and Written Opinion of the International Searching Authority for International application No. PCT/US2014/053040 dated Dec. 10, 2014.
International Preliminary Report on Patentability for PCT Application No. PCT/US2014/053040, dated Mar. 24, 2016.

* cited by examiner

BLADE OUTER AIR SEAL HAVING ANGLED RETENTION HOOK

BACKGROUND

This disclosure relates to a gas turbine engine, and more particularly to a blade outer air seal (BOAS) that may be incorporated into a gas turbine engine.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other loads.

The compressor and turbine sections of a gas turbine engine include alternating rows of rotating blades and stationary vanes. The turbine blades rotate and extract energy from the hot combustion gases that are communicated through the gas turbine engine. The turbine vanes direct the hot combustion gases at a preferred angle of entry into a downstream row of blades.

An engine case of an engine static structure may include one or more blade outer air seals (BOAS) that establish an outer radial flow path boundary for channeling the hot combustion gases. BOAS are typically mounted to the engine casing with one or more retention hooks.

SUMMARY

A blade outer air seal (BOAS) according to an exemplary aspect of the present disclosure includes, among other things, a ceramic body having a radially inner face and a radially outer face and a retention feature that extends from the radially outer face. The retention feature includes at least one angled hook that extends at a transverse angle relative to the radially outer face.

In a further non-limiting embodiment of the foregoing BOAS, the at least one angled hook is tapered between a base and an end.

In a further non-limiting embodiment of either of the foregoing BOAS, the at least one angled hook includes a tapered end.

In a further non-limiting embodiment of any of the foregoing BOAS, the ceramic body and the retention feature together form a monolithic structure.

In a further non-limiting embodiment of any of the foregoing BOAS, the retention feature includes a curved body.

In a further non-limiting embodiment of any of the foregoing BOAS, the retention feature includes a first angled hook and a second angled hook.

In a further non-limiting embodiment of any of the foregoing BOAS, a retention block is positionable relative to the angled hook to retain the BOAS to adjacent hardware.

In a further non-limiting embodiment of any of the foregoing BOAS, the retention block includes a tapered arm that establishes a slidable interface relative to the at least one angled hook.

In a further non-limiting embodiment of any of the foregoing BOAS, the at least one angled hook defines a ramp angle that extends between an inner surface of the at least one angled hook and an axis that is parallel to an engine centerline longitudinal axis of a gas turbine engine.

In a further non-limiting embodiment of any of the foregoing BOAS, the ramp angle is between 15° and 45°.

A gas turbine engine according to an exemplary aspect of the present disclosure includes, among other things, an engine case, a first BOAS and a retention block separate from the first BOAS and configured to mount the first BOAS to the engine case.

In a further non-limiting embodiment of the foregoing gas turbine engine, the retention block is mechanically mounted to the engine case.

In a further non-limiting embodiment of either of the foregoing gas turbine engines, the first BOAS is slidable relative to the retention block to position a radially inner face of the first BOAS radially inboard toward a blade tip.

In a further non-limiting embodiment of any of the foregoing gas turbine engines, the retention block is positioned circumferentially between the first BOAS and a second BOAS.

In a further non-limiting embodiment of any of the foregoing gas turbine engines, the BOAS includes an angled retention hook that contacts a tapered arm of the retention block.

A method of retaining a blade outer air seal (BOAS) according to another exemplary aspect of the present disclosure includes, among other things, attaching a retention block to an engine case and positioning an angled retention hook of a BOAS relative to the retention block to mount the BOAS to the engine case.

In a further non-limiting embodiment of the foregoing method, the method of positioning includes isolating the BOAS from thermal growth of the engine case by forming the BOAS from a ceramic material.

In a further non-limiting embodiment of either of the foregoing methods, the method of positioning includes establishing a slidable interface between a tapered arm of the retention block and the angled retention hook of the BOAS.

In a further non-limiting embodiment of any of the foregoing methods, the method includes sliding a portion of the BOAS relative to the retention block to move the BOAS relative to a blade tip in response to a temperature change of the engine case.

In a further non-limiting embodiment of any of the foregoing methods, prior to the method of positioning, positioning a seal plate relative to one of the retention block and the BOAS.

The embodiments, examples and alternatives of the preceding paragraphs, the claims, or the following descriptions and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to a blade outer air seal (BOAS) for use in a gas turbine engine. The BOAS of this disclosure include angled retention features that interface with retention blocks that are mounted to an engine case. Corresponding portions of both the BOAS and the retention block may be tapered to provide a slidable interface between the two components. Movement of the BOAS relative to the retention block along the slidable interface in response to thermal growth of the engine case closes a gap between a blade tip and the BOAS, thereby improving engine efficiency. These and other features are described in detail herein.

Figure 1:
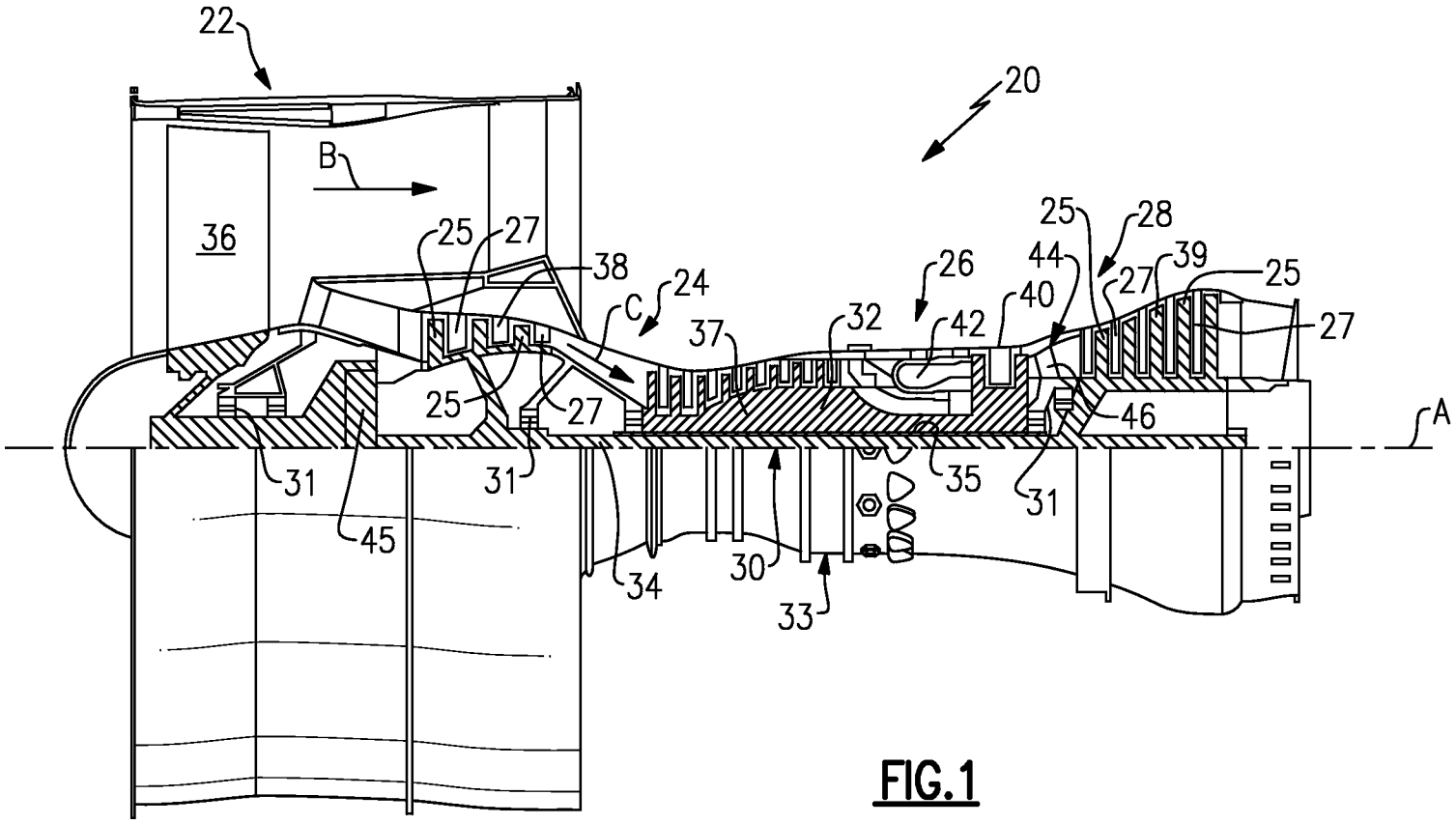
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in this non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the fan 36 and/or the low pressure compressor 38 and the high pressure compressor 37, is mixed with fuel and burned in the combustor 42, and is then expanded through the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be calculated by measuring the pressure prior to the inlet of the low pressure turbine 39 and relating it to the pressure measured at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In one embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}\ ^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Figure 2:
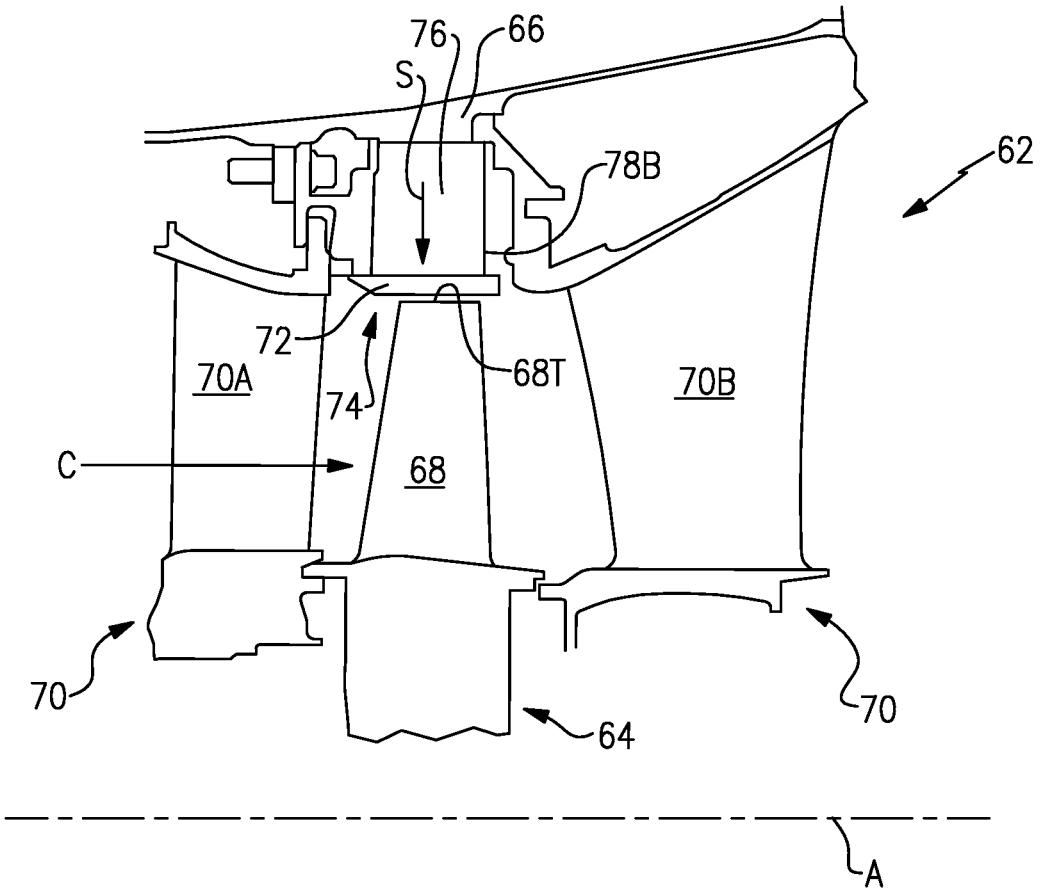
FIG. 2 illustrates a cross-section of a portion of a gas turbine engine.

FIG. 2 illustrates a portion 62 of a gas turbine engine, such as the gas turbine engine 20 of FIG. 1. In the illustrated embodiment, the portion 62 is representative of the high pressure turbine 40. However, it should be appreciated that other portions of the gas turbine engine 20 could benefit from the teachings of this disclosure, including but not limited to, the compressor section 24 and the low pressure turbine 39.

In one exemplary embodiment, a rotor disk 64 (only one shown, although multiple disks could be disposed within the portion 62) is mounted for rotation about the engine centerline longitudinal axis A relative to an engine case 66 of the engine static structure 33 (see FIG. 1). The portion 62 includes alternating rows of rotating blades 68 (mounted to the rotor disk 64) and vanes (features 70A, 70B) of vane assemblies 70 that are also supported relative to the engine case 66.

Each blade 68 of the rotor disk 64 extends to a blade tip 68T at a radially outermost portion of the blades 68. The blade tip 68T extends toward a blade outer air seal (BOAS)

72 (shown schematically in FIG. 2). The BOAS 72 may be a segment of a BOAS assembly 74. For example, a plurality of BOAS 72 may be circumferentially positioned relative to one another to provide a segmented BOAS assembly 74 that generally surrounds the rotor disk 64 and the blades 68 carried by the rotor disk 64.

The BOAS assembly 74 is disposed in an annulus 76 that extends radially between the engine case 66 and the blade tip 68T. Optionally, a secondary cooling fluid S that is separate from the core flow path C may be communicated into the space defined by the annulus 76 to provide a dedicated source of cooling fluid for cooling the BOAS 72 and other nearby hardware. In one embodiment, the secondary cooling fluid S is airflow sourced from the high pressure compressor 37 or any other upstream portion of the gas turbine engine 20.

Figure 3:
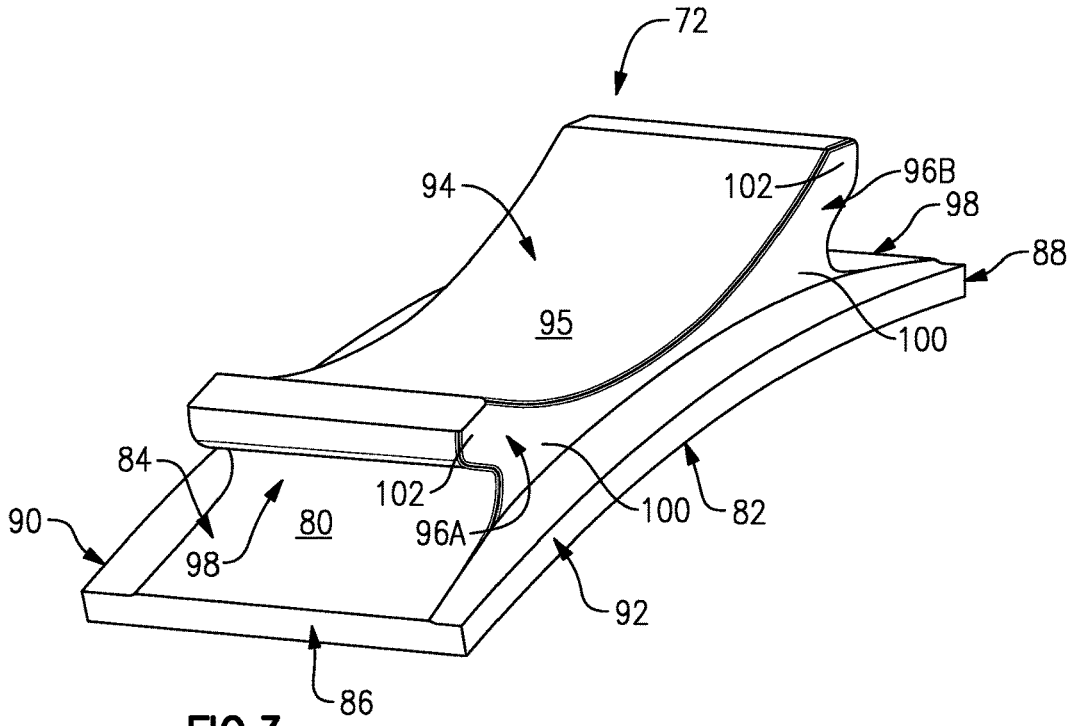
FIG. 3 illustrates a blade outer air seal (BOAS).

FIG. 3, with continued reference to FIG. 2, illustrates a BOAS 72 that may be incorporated into a gas turbine engine, such as the portion 62 of FIG. 2. The BOAS 72 may include a ceramic body 80 having a radially inner face 82 and a radially outer face 84. In a mounted position, the radially inner face 82 faces toward a blade tip 68T and the radially outer face 84 faces toward the engine case 66 (see FIG. 2). The radially inner face 82 and the radially outer face 84 circumferentially extend between a first mate face 86 and a second mate face 88 and axially extend between a leading edge face 90 and a trailing edge face 92.

The BOAS 72 includes a retention feature 94 that extends from the radially outer face 84. In one embodiment, the ceramic body 80 and the retention feature 94 embody a unitary structure (i.e., a monolithic structure) manufactured of a ceramic, ceramic matrix composite, or other suitable ceramic material. The retention feature 94 may be utilized to mount the BOAS 72 to the engine case 66.

The retention feature 94 can include a curved body 95. In one non-limiting embodiment, the curved body 95 is curved in an opposite direction from a curvature of the radially inner face 82. In other words, in a mounted position, the curved body 95 is curved toward the engine case 66 and the radially inner face 82 is curved toward the blade tip 68T.

The retention feature 94 additionally includes at least one angled hook 96 that extends at a transverse angle relative to the radially outer face 84. In one embodiment, the retention feature 94 includes a first angled hook 96A near the first mate face 86 and a second angled hook 96B near the second mate face 88. The curved body 95 connects the first angled hook 96A to the second angled hook 96B. In other words, the angled hooks 96A, 96B establish opposing ends of the curved body 95.

Each angled hook 96 may extend between a base 100 and an end 102. The ends 102 of the angled hooks 96 are circumferentially offset from the first and second mate faces 86, 88, in one non-limiting embodiment.

In another non-limiting embodiment, each angled hook 96 is tapered between the base 100 and the end 102. Alternatively, only the end 102 of the angled hook 96 is tapered such that the ends 102 are V-shaped. As is discussed in greater detail below, the tapered surfaces of the angled hooks 96 aid in establishing a slidable interface for effectuating radially inboard movement of the BOAS 72 relative to a blade tip 68T in response to a temperature change, or thermal growth, of the engine case 66.

A recessed opening 98 extends between each angled hook 96 and the radially outer face 84 of the BOAS 72. Portions of a retention block 104 (see FIGS. 6 and 7) may be received within the recessed opening 98 to mount the BOAS 72 relative to the engine case 66.

Figure 4:
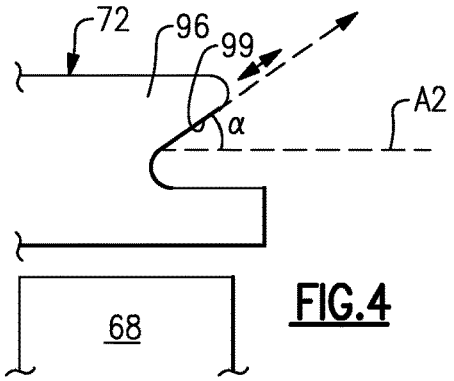
FIG. 4 illustrates an angled hook of a BOAS.

Referring to FIG. 4, each angled hook 96 may define a ramp angle $\alpha$ that extends between an inner surface 99 of the angled hook 96 and an axis A2 that is parallel to the engine centerline longitudinal axis A. In one embodiment, the ramp angle $\alpha$ is greater than 15°. In another embodiment, the ramp angle $\alpha$ is greater than 25°. In yet another embodiment, the ramp angle $\alpha$ is between 25° and 45°.

Other angles may also be suitable depending on certain design criteria. For example, altering the ramp angle $\alpha$ can change the amount of relative sliding that occurs between the BOAS 72 and a retention block 104 (see FIGS. 6 and 7) during an engine case temperature change. Because of its ceramic properties, which exhibit a relatively low coefficient of thermal expansion, the BOAS 72 is a relatively small contributor to the thermal growth and may therefore move slightly inboard along the ramp angle $\alpha$ toward a blade 68 to provide tip clearance benefits during thermal growth of the engine case 66. In other words, the ceramic BOAS 72 is isolated from the thermal growth of the engine case 66 by utilizing the exemplary support structure of the angled hooks 96.

Figure 5:
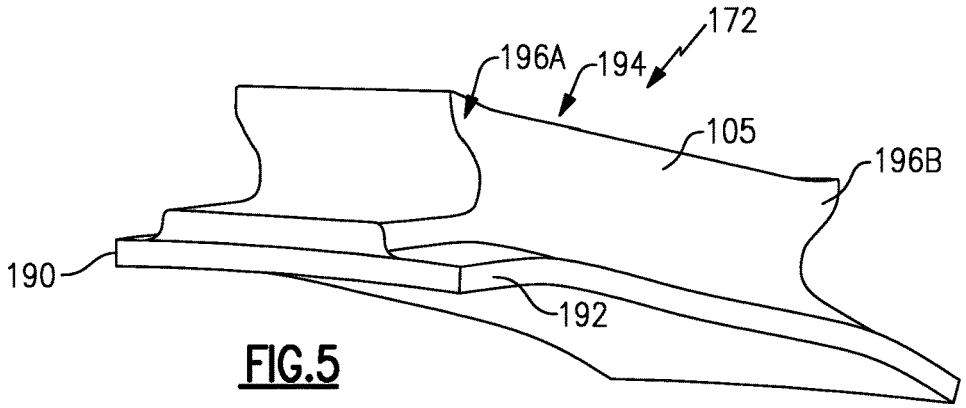
FIG. 5 illustrates another BOAS.

FIG. 5 illustrates a second embodiment of a BOAS 172. In this disclosure, like reference numerals designate like elements where appropriate and reference numerals with the addition of 100 or multiples thereof designate modified elements that are understood to incorporate the same features and benefits of the corresponding original elements. In this embodiment, a wall 105 extends between angled hooks 196A, 196B of a retention feature 194 of the BOAS 172. In one embodiment, a wall 105 connects between the angled hooks 196A, 196B adjacent both a leading edge face 190 and a trailing edge face 192 of the BOAS 172. The walls 105 may improve the strength of the retention feature 194 of the BOAS 172.

Figure 6A:
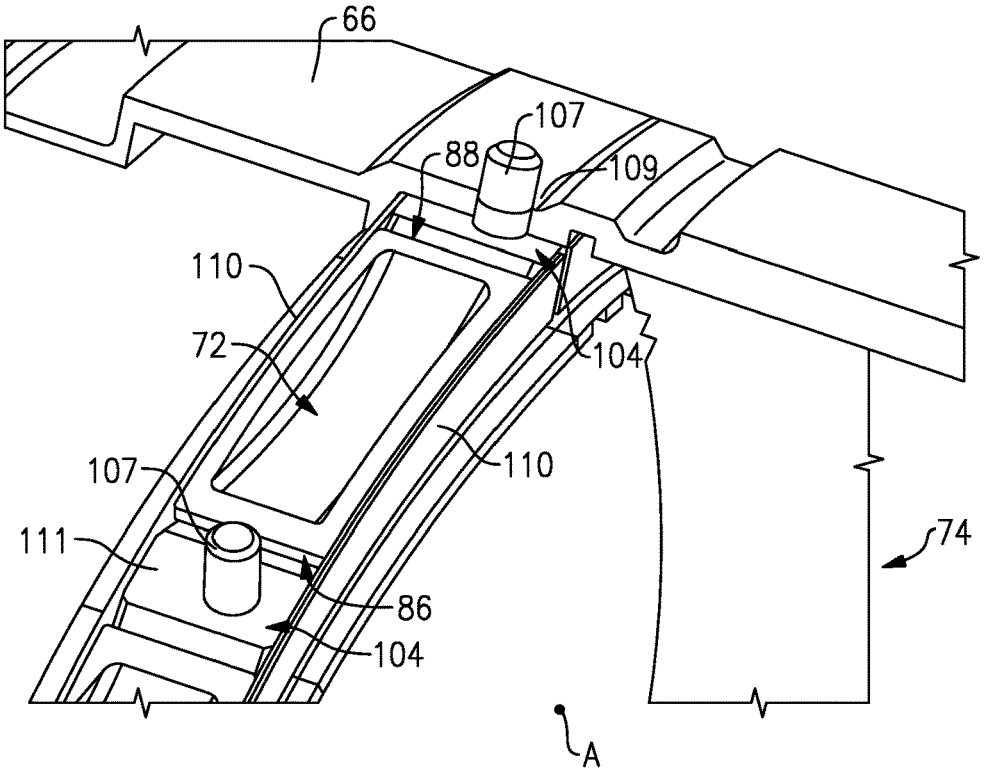
FIGS. 6A, 6B and 6C illustrate a first BOAS assembly.
Figure 6B:
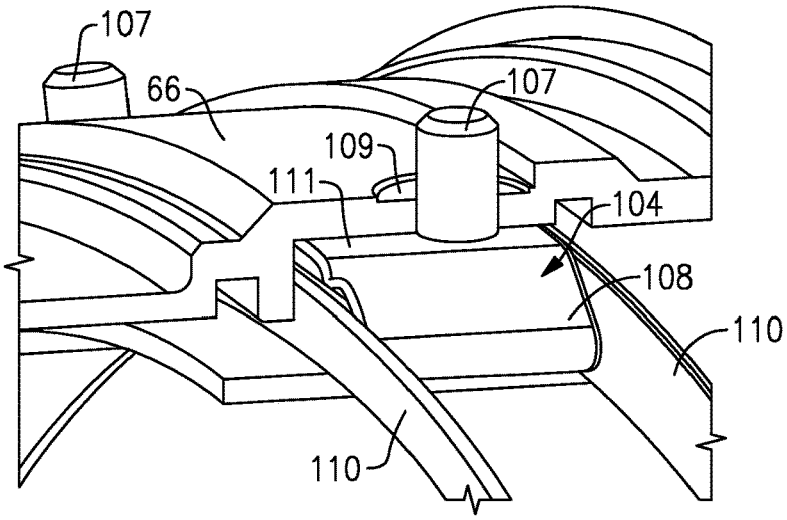
Figure 6C:
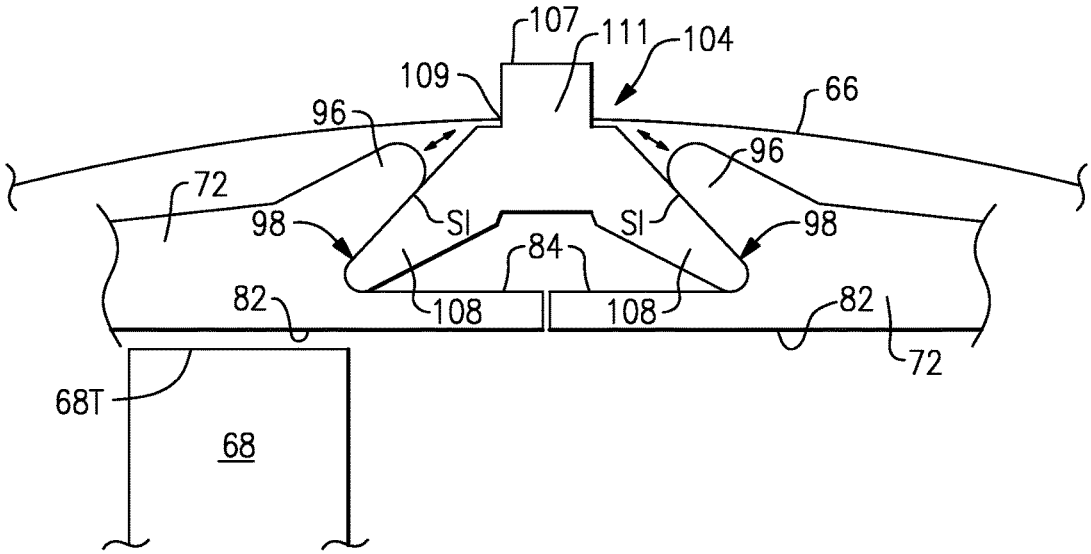

Referring to FIGS. 6A, 6B and 6C, a retention block 104 may be used to attach a BOAS 72 (or 172) to an engine case 66. In one embodiment, the retention block 104 is a separate structure from the BOAS 72. One retention block 104 may be positioned relative to each of the first mate face 86 and the second mate face 88 of the BOAS 72 to mount a plurality of BOAS 72 about the engine longitudinal centerline axis A as part of a BOAS assembly 74. In other words, a retention block 104 can be positioned circumferentially between each BOAS 72 of a BOAS assembly 74.

In one embodiment, the retention block 104 is a ceramic block that includes a pin 107 and a pair of tapered arms 108. The pin 107 extends from a body 111 of the retention block 104 and can be received within an opening 109 in the engine case 66 to secure the retention block 104 thereto. The pin 107 can be secured to the engine case 66 by a nut or other mechanical device, or could alternatively be welded.

Seal plates 110 may be positioned at the leading edge face 90 and a trailing edge face 92 of the BOAS 72 to seal the BOAS 72 at these locations. The seal plates 110 may also act as shims. The seal plates 110 may be positioned relative to the retention blocks 104 prior to positioning the BOAS 72. In one embodiment, a number of seal plates 110 are stacked on top of one another and positioned relative to the retention blocks 104. The seal plates 110 may embody segmented or full hoop designs.

In one non-limiting embodiment, the BOAS 72 may be positioned relative to the retention blocks 104 after the retention blocks 104 are secured to the engine case 66. For example, as best shown in FIG. 6C, the tapered arms 108 of the retention block 104 extend at a transverse angle from the body 111 and may be received within the recessed openings 98 that extend between the radially outer face 84 and angled hooks 96 of the BOAS 72. In one embodiment, the angled hooks 96 of the BOAS 72 and the tapered arms 108 define a slidable interface SI for moving the BOAS 72 relative to a blade tip 68T during a temperature change of the engine case 66. The temperature change may cause the engine case 66 to thermally grow. During this thermal growth, the angled hooks 96 of the BOAS 72 may slide relative to the tapered arms 108 of the retention block 104 along the slidable interface SI. The BOAS 72 themselves experience little, if any, thermal growth by virtue of their ceramic nature and therefore can slide relative to the retention blocks 104. As the BOAS 72 slide, the radially inner face 82 of the BOAS 72 moves radially inboard toward the blade tip 68T. A tighter clearance between the BOAS 72 and the blade tip 68T may result in improved engine efficiency.

Figure 7A:
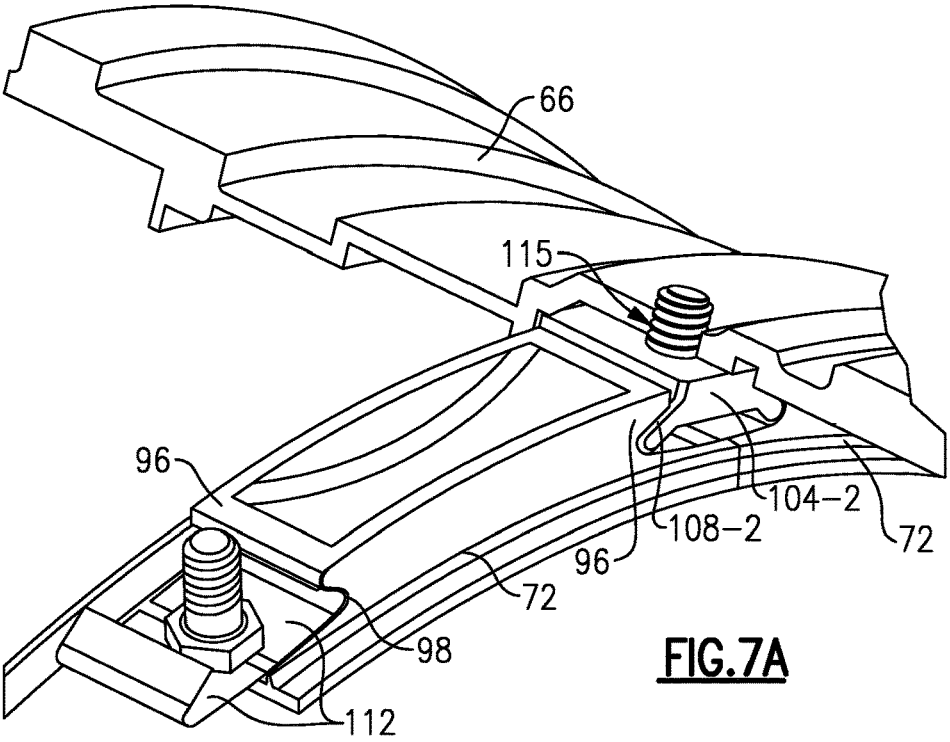
FIGS. 7A and 7B illustrate a second BOAS assembly.
Figure 7B:
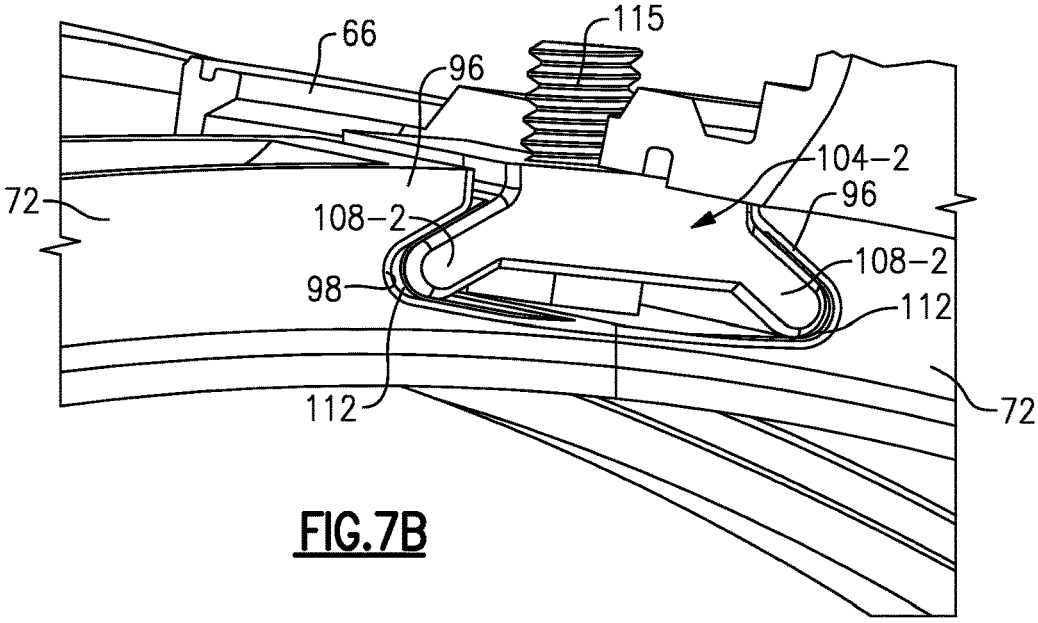

FIGS. 7A and 7B illustrate another retention block 104-2 that can be used to mount one or more BOAS 72 relative to an engine case 66. The retention block 104-2 functions similar to the retention block 104 of FIGS. 6A, 6B and 6C. However, in this embodiment, the retention block 104-2 is a cast or machined block having a pair of tapered arms 108-2. The retention block 104-2 may be secured to the engine case 66 by a fastener 115, such as a bolt.

A compliant layer 112 may be positioned between the tapered arms 108-2 of the retention block 104-2 and the angled hooks 96 of the BOAS 72, such as within the recessed openings 98. The compliant layers 112 seal between the BOAS 72 and the retention blocks 104-2. In one embodiment, the compliant layers 112 are layers of thin sheet metal that can be bent into a desired shape. Other seals are also contemplated.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A blade outer air seal (BOAS) assembly, comprising:

an engine case extending along an engine centerline longitudinal axis of a gas turbine engine;

a blade outer air seal comprising:

a ceramic body having a radially inner face and a radially outer face that extend circumferentially between a first mate face and a second mate face;

a retention feature that extends from said radially outer face; and wherein said retention feature includes a first angled hook adjacent said first mate face that extends at a first transverse angle relative to said radially outer face and a second angled hook adjacent said second mate face that extends at a second transverse angle relative to said radially outer face; and first and second retention blocks positionable relative to said first and second angled hooks to retain said BOAS to adjacent hardware, wherein said first and second retention blocks are ceramic blocks;

wherein said first retention block includes a first retention body, a first pin extending radially outward from said first retention body and a pair of first tapered arms extending radially inward from opposed sides of said first retention body, a tapered arm of said pair of first tapered arms establishing a first slidable interface relative to said first angled hook;

wherein said second retention block includes a second retention body, a second pin extending radially outward from said second retention body and a pair of second tapered arms extending radially inward from opposed sides of said second retention body, a tapered arm of said pair of second tapered arms establishing a second slidable interface relative to said second angled hook; and wherein said first and second pins are received in respective openings of said engine case to secure said first and second retention blocks to said engine case, said first pin is circumferentially between said pair of first tapered arms, and said second pin is circumferentially between said pair of second tapered arms.

2. The BOAS assembly as recited in claim 1, wherein each of said first and second angled hooks is tapered between a base and an end.

3. The BOAS assembly as recited in claim 1, wherein each of said first and second angled hooks includes a tapered end.

4. The BOAS assembly as recited in claim 1, wherein said ceramic body and said retention feature together form a monolithic structure.

5. The BOAS assembly as recited in claim 1, wherein said retention feature includes a curved body.

6. The BOAS assembly as recited in claim 1, wherein each of said first and second angled hooks defines a ramp angle that extends between an inner surface of a respective one of said first and second angled hooks and an axis that is parallel to said engine centerline longitudinal axis.

7. The BOAS assembly as recited in claim 6, wherein said ramp angle is between 15° and 45°.

8. A gas turbine engine, comprising:

an engine case extending along an engine longitudinal axis;

a first blade outer air seal (BOAS) and a second BOAS arranged circumferentially about said engine longitudinal axis to bound a core flow path;

wherein each of said first and second BOAS comprises:

a ceramic body having a radially inner face and a radially outer face that extend circumferentially between a first mate face and a second mate face;

a retention feature that extends from said radially outer face; and wherein said retention feature includes a first angled retention hook adjacent said first mate face that extends at a first transverse angle relative to said radially outer face and a second angled retention hook adjacent said second mate face that extends at a second transverse angle relative to said radially outer face; and a retention block separate from said first and second BOAS and configured to mount said first and second BOAS to said engine case, wherein said retention block is a ceramic block;

wherein said retention block is positioned circumferentially between said first angled retention hook of said first BOAS and said second angled retention hook of said second BOAS to retain said first and second BOAS to said engine case;

wherein said retention block includes a retention body and a first pin extending radially outward from said retention body, and said first pin is received in an opening of said engine case to secure said retention block to said engine case;

wherein said retention block includes first and second tapered arms that extend radially inwardly from opposed sides of said retention body such that said first tapered arm establishes a first slidable interface relative to said first angled hook of said first BOAS and such that said second tapered arm establishes a second slidable interface relative to said second angled hook of said second BOAS, each of said first and second slidable interfaces having a directional component that extends in a radial direction relative to said engine longitudinal axis, and said first pin is circumferentially between said first and second tapered arms.

9. The gas turbine engine as recited in claim 8, wherein said retention block is mechanically mounted to said engine case.

10. The gas turbine engine as recited in claim 8, wherein said first BOAS is slidable relative to said retention block to position said radially inner face of said first BOAS radially inboard toward a blade tip.

11. The gas turbine engine as recited in claim 8, wherein each of the first and second BOAS further comprises:

a curved body, and the first and second angled retention hooks establish circumferentially opposing ends of the curved body with respect to the engine centerline longitudinal axis.

12. The gas turbine engine as recited in claim 11, wherein each of said first angled retention hook and said second angled retention hook defines a ramp angle that extends between an inner surface of a respective one of said first and second angled retention hooks and an axis that is parallel to said engine centerline longitudinal axis, and wherein said ramp angle is between 15° and 45° such that said inner surface has a directional component that extends in said radial direction.

13. The gas turbine engine as recited in claim 12, wherein said first angled retention hook and said second angled retention hook of each one of said first and second BOAS extend in a circumferential direction towards said first mate face and said second mate face, respectively.

14. A method of retaining a blade outer air seal (BOAS), comprising:

attaching first and second retention blocks to an engine case, wherein the first and second retention blocks are ceramic blocks;

wherein the first retention block includes a first retention body, a first pin extending radially outward from the first retention body and a pair of first tapered arms extending radially inward from opposed sides of the first retention body, and said first pin is circumferentially between said pair of first tapered arms;

positioning a first angled retention hook of the BOAS relative to the first retention block to mount the BOAS to the engine case, including establishing a first slidable interface between a tapered arm of the pair of first tapered arms of the first retention block and the first angled retention hook, and the BOAS having a curved body;

wherein the second retention block includes a second retention body, a second pin extending radially outward from the second retention body and a pair of second tapered arms extending radially inward from opposed sides of the second retention body, and said second pin is circumferentially between said pair of second tapered arms;

positioning a second angled retention hook of the BOAS relative to the second retention block to mount the BOAS to the engine case, including establishing a second slidable interface between a tapered arm of the pair of second tapered arms of the second retention block and the second angled retention hook;

wherein the first and second angled retention hooks establish circumferentially opposing ends of the curved body; and wherein the first and second pins are received in respective openings of the engine case to secure the first and second retention blocks to the engine case.

15. The method as recited in claim 14, wherein the BOAS comprises a ceramic material.

16. The method as recited in claim 14, comprising the step of moving the BOAS relative to the first and second retention blocks in a radial direction relative to a blade tip in response to a temperature change of the engine case.

17. The method as recited in claim 14, prior to the steps of positioning the first and second angled retention hooks, positioning a seal plate relative to the first and second retention blocks and the BOAS.

* * * * *